US006807679B1

(12) United States Patent
Wang-Lee

(10) Patent No.: US 6,807,679 B1
(45) Date of Patent: Oct. 26, 2004

(54) MECHANISM FOR SECURING EYE PROTECTOR TO HELMET

(75) Inventor: Tzu-Feng Wang-Lee, Tainan (TW)

(73) Assignee: Chen Li Optical Co., Ltd., Tainan (TW)

( * ) Notice: Subject to any disclaimer, the term of this patent is extended or adjusted under 35 U.S.C. 154(b) by 0 days.

(21) Appl. No.: 10/409,928

(22) Filed: Apr. 9, 2003

(51) Int. Cl.[7] ..... A61F 9/00; A42B 1/08

(52) U.S. Cl. ..... 2/10; 2/424; 16/334; 403/95; 403/96

(58) Field of Search ..... 2/424, 10; 16/334, 16/335, 336, 337; 403/92, 94, 95, 96, 101, 112

(56) References Cited

U.S. PATENT DOCUMENTS 3,067,426 A * 12/1962 Tompkins ..... 2/8
4,124,902 A * 11/1978 Seres et al. ..... 2/10
4,442,551 A * 4/1984 Hellberg ..... 2/10
4,479,738 A * 10/1984 Kubnick ..... 403/329
4,796,308 A * 1/1989 Bourgeois ..... 2/10
5,966,738 A * 10/1999 Wang Lee ..... 2/10
6,041,435 A * 3/2000 Paulson et al. ..... 2/10
6,264,392 B1 * 7/2001 Wise et al. ..... 403/112
6,457,180 B1 * 10/2002 Jung ..... 2/12

* cited by examiner

*Primary Examiner*—Rodney M. Lindsey
(74) *Attorney, Agent, or Firm*—Alan D. Kamrath; Nikolai & Mersereau, P.A.

(57) ABSTRACT

A mechanism includes two units for securing a transparent eye protector to a helmet having a recess at either side. Each unit comprises a bracket formed at one end of a frame of the eye protector. The bracket includes, at a free end thereof, an inner raised, round surface, radial first ridges on the raised, round surface, an outer recessed, round surface, and a central hole through the round surfaces. Separate snapping members include two lower, resilient latched pieces inserted into each recess for releasably securing to the helmet, radial second ridges at an upper, outer surface, and a central hole through the upper, outer surface. Bolts are driven through the central holes for fastening the snapping members and the brackets together. Pivoting of the ridges of the bracket about the ridges of the snapping member is done by pulling the eye protector up or down about the helmet.

2 Claims, 3 Drawing Sheets

MECHANISM FOR SECURING EYE PROTECTOR TO HELMET

FIELD OF THE INVENTION

The present invention relates to helmets and more particularly to a mechanism for securing an eye protector to a helmet with improved characteristics.

BACKGROUND OF THE INVENTION

A helmet (e.g., one worn by a worker) equipped with a transparent eye protector is well known. Conventionally, fasteners (e.g., screws) are driven to fasten the eye protector and the helmet together. Such simple prior fastening mechanism is typically trouble-prone and unreliable in use. Thus, the need for improvement still exists.

SUMMARY OF THE INVENTION

It is therefore an object of the present invention to provide a mechanism including two units for securing a transparent eye protector to a helmet having a recess at either side. Each unit comprises a bracket integrally formed with one end of an arcuate frame of the eye protector. The bracket includes, at a free end thereof, an inner raised, round surface, a plurality of equally spaced apart radial ridges on the inner raised, round surface, an outer recessed, round surface, and a central hole through the inner raised and outer recessed round surfaces. Snapping means include two lower, resilient latched pieces inserted into each of the recesses for releasably securing to the helmet, a plurality of equally spaced apart radial ridges at an upper, outer surface, and a central aperture through the upper, round surface. Fastening means are driven through the central hole and aperture for fastening the snapping means and the bracket together. Pivoting of the ridges of the bracket about the ridges of the snapping means a predetermined angle is done by passing the ridges of the bracket over the ridges of the snapping means, thereby fixing the eye protector with respect to the helmet at the predetermined angle. By utilizing this mechanism, a trouble-free and reliable mechanism for securing an eye protector to a helmet is obtained.

The above and other objects, features and advantages of the present invention will become apparent from the following detailed description taken with the accompanying drawings.

DETAILED DESCRIPTION OF THE PREFERRED EMBODIMENTS

Figure 1:
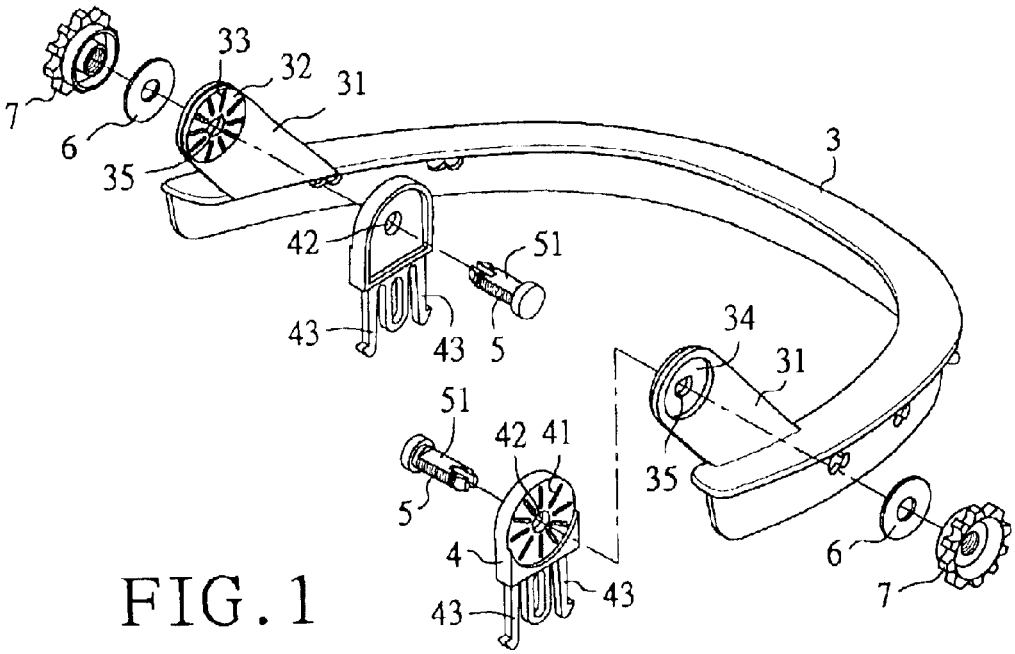
FIG. 1 is an exploded view of a preferred embodiment of a mechanism for securing an eye protector to a helmet according to the invention.
Figure 2:
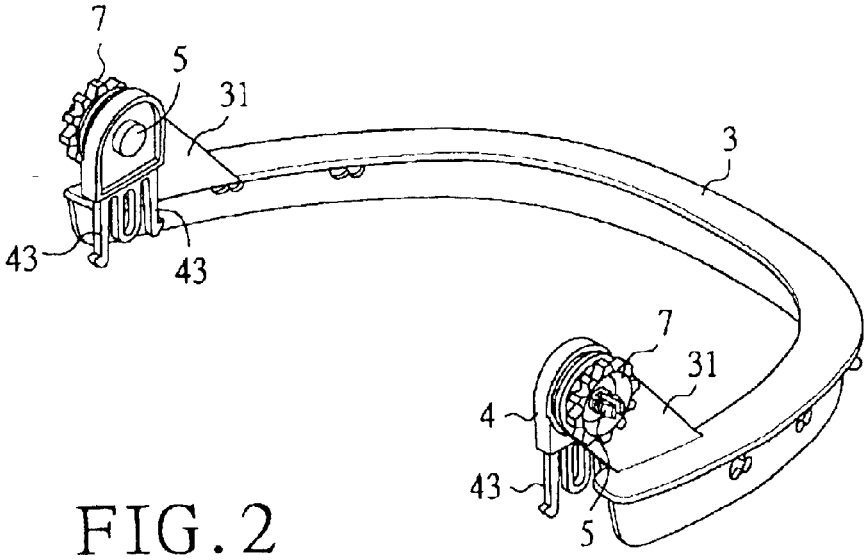
FIG. 2 is a perspective view of the assembled mechanism on a frame of eye protector of FIG. 1.
Figure 3:
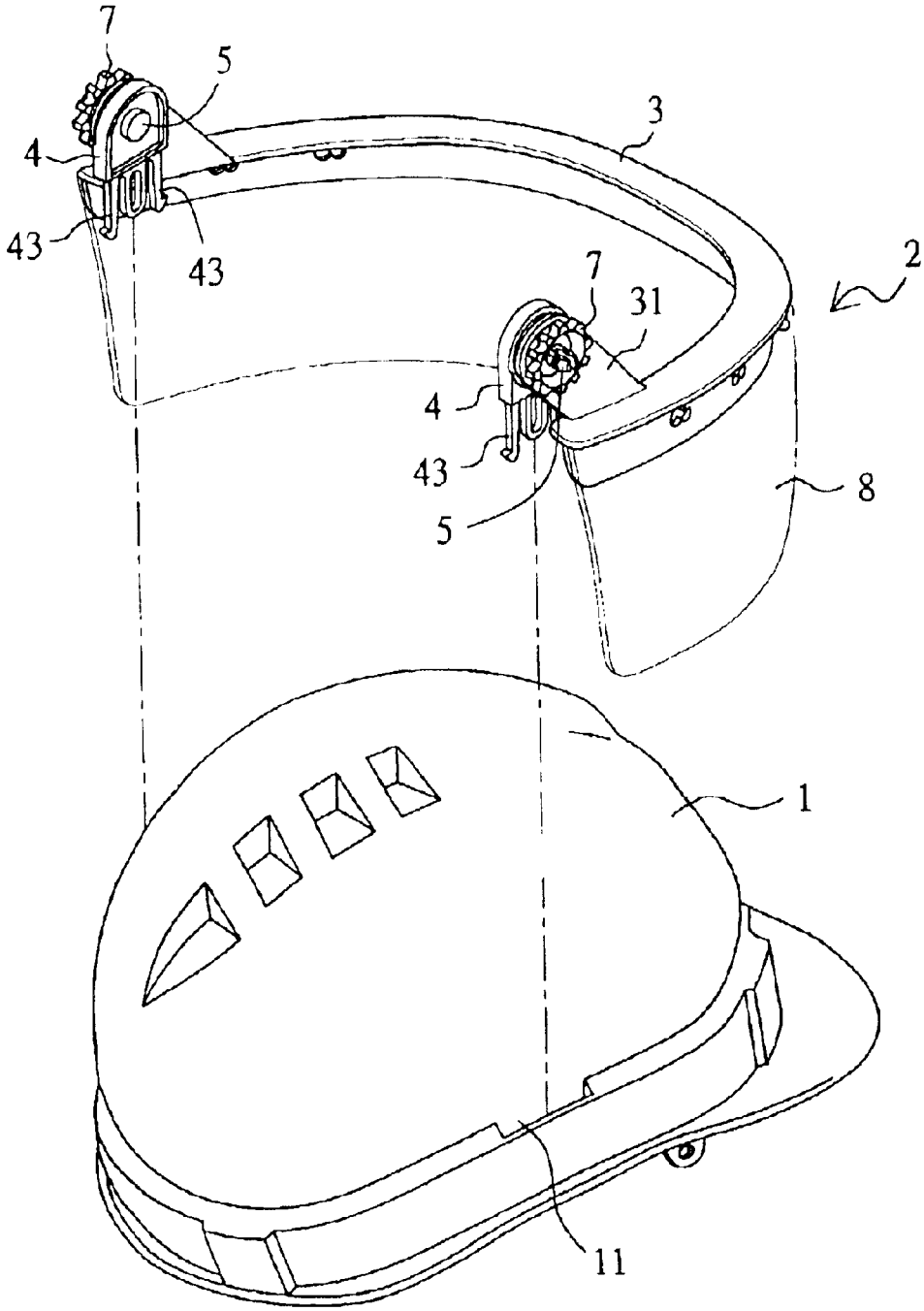
FIG. 3 is a perspective view of an eye protector equipped with the mechanism of FIG. 1 to be secured to a helmet.

Referring to FIGS. 1, 2, and 3, there is shown a fastening mechanism of a helmet constructed in accordance with the invention. The mechanism is mounted at either end of an arcuate frame 3 mounting a shield 8 of a transparent eye protector 2. The mechanism comprises a bracket 31 integrally formed with the frame 3. At a free end of the bracket 31, there are formed an inner raised, round surface 32, a plurality of equally spaced apart radial ridges 33 on the inner raised, round surface 32, an outer recessed, round surface 34, and a central hole 35 through the round surfaces 32 and 34. The mechanism further comprises a separate snapping member 4 including two lower, resilient latched pieces 43, a plurality of equally spaced apart radial ridges 41 at an upper, outer surface, and a central hole 42 through the upper, outer surface of the snapping member 4. A threaded bolt 5 having a flat 51 on its shank, driven through the central holes 42 and 35, a washer 6, and a nut 7 fastens the snapping member 4 and the bracket 31 together.

Figure 4:
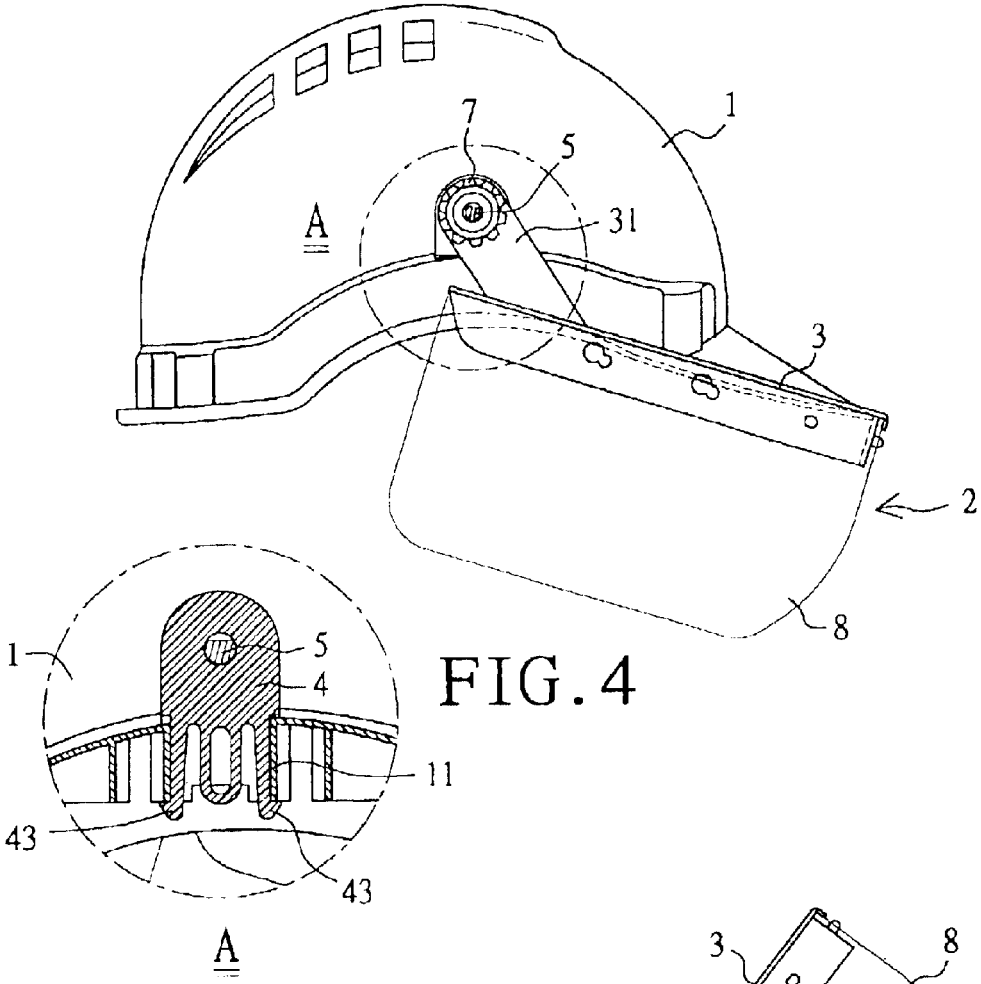
FIG. 4 is a side plan view of the assembled eye protector and helmet of FIG. 3 where the eye protector is pulled down and a greatly enlarged, fragmentary, cross-sectional view is shown in circle A.
Figure 5:
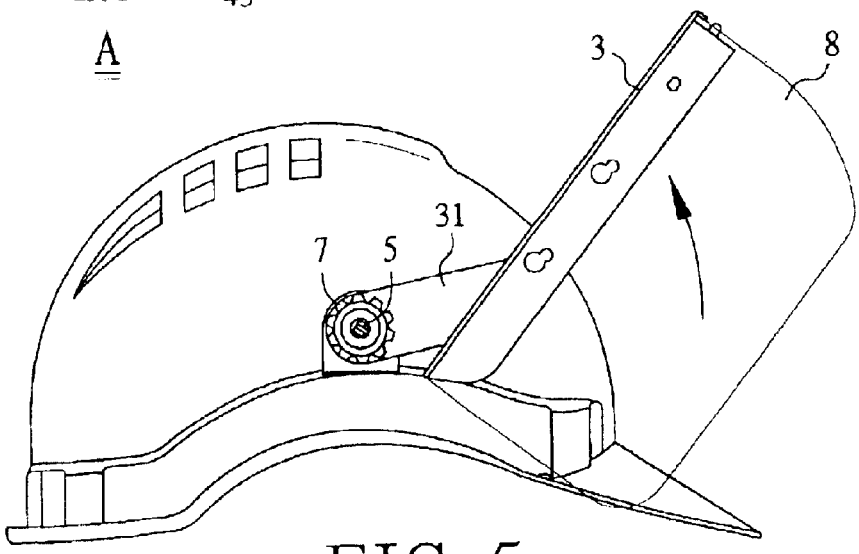
FIG. 5 is a side plan view of the assembled eye protector and helmet of FIG. 3 where the eye protector is pulled up.

Referring to FIGS. 4 and 5 in conjunction with FIG. 3, an assembly of the eye protector 2 and a helmet 1 by means of the fastening mechanisms and a pivoting of the eye protector 2 with respect to the helmet 1 will now be described in detail below. The helmet 1 has a recess 11 at either side. The latched pieces 43 are inserted into each of the recesses 11 for fastening. This finishes the assembly of the eye protector 2 and the helmet 1. Moreover, in use, a user can pull the eye protector 2 up or down by pivoting the eye protector 2 with respect to the helmet 1 in which the ridges 33 of the bracket 31 pivot about the ridges 41 of the snapping member 4 until a desirable angle is reached by passing the ridges 33 over the ridges 41. In response to an adjustment of the desired opening or closing angle of the eye protector 2, the eye protector 2 is fixed with respect to the helmet I because of the cooperation of the ridges 33 of the bracket 31 and the ridges 41 of the snapping member 4. Also, a user can press the latched pieces 43 toward each other at either side of the helmet 1 for disengaging the latched pieces 43 from the recess 11 prior to detaching the eye protector 2 from the helmet 1.

While the invention has been described by means of specific embodiments, numerous modifications and variations could be made thereto by those skilled in the art without departing from the scope and spirit of the invention set forth in the claims.

What is claimed is:

1. A mechanism including two units for securing a transparent eye protector to a helmet having a recess at either side, each unit comprising:

a bracket integrally formed with one end of an arcuate frame of the eye protector, the bracket having first and second opposing faces, with each bracket including, at a free end thereof, an inner raised, round surface raised beyond the first face, a plurality of equally spaced apart radial ridges on the inner raised, round surface, an outer recessed, round surface recessed below the second face, and a central hole through the inner raised and outer recessed round surfaces;

snapping means including two lower, resilient latched pieces insertable into the respective recess for releasably securing to the helmet, a plurality of equally spaced apart radial ridges at an upper, outer surface, and a central aperture through the upper, outer surface, with the upper, outer surface being recessed to rotatably receive the inner raised, round surface;

a bolt:

a washer: and a nut, with the bolt driven through the central hole and aperture for fastening the snapping means and the bracket together, with the washer and nut being rotatably received in the outer recessed, round surface, wherein a pivoting of the ridges of the bracket about the ridges of the snapping means is done by passing the ridges of the bracket over the ridges of the snapping means, thereby fixing the eye protector with respect to the helmet.

2. The mechanism of claim 1, wherein the bolt comprises a flat on a shank thereof, with the central hole including a flat corresponding to the flat on the shank of the bolt.

* * * * *